US006905065B2

(12) United States Patent
Holden

(10) Patent No.: US 6,905,065 B2
(45) Date of Patent: Jun. 14, 2005

(54) AMBIDEXTROUS SECTIONAL PIZZA BOX

(75) Inventor: Christopher Guy Lawrence Holden, Harrow (CA)

(73) Assignee: Pizza Box 2000, Inc., Windsor (CA)

( * ) Notice: Subject to any disclaimer, the term of this patent is extended or adjusted under 35 U.S.C. 154(b) by 0 days.

(21) Appl. No.: 10/435,460

(22) Filed: May 12, 2003

(65) Prior Publication Data

US 2003/0209592 A1 Nov. 13, 2003

Related U.S. Application Data

(60) Provisional application No. 60/378,987, filed on May 10, 2002.

(51) Int. Cl.[7] ..... B65D 5/54

(52) U.S. Cl. ..... 229/103; 229/906; 229/942

(58) Field of Search ..... 229/101, 103, 229/115, 902, 906, 942; 206/551; 426/115

(56) References Cited

U.S. PATENT DOCUMENTS 798,264 A * 8/1905 Carrier ..... 229/107
3,335,846 A * 8/1967 Mills ..... 206/551
3,771,713 A * 11/1973 Davidson ..... 206/551
5,014,853 A 5/1991 Crockett
5,110,038 A * 5/1992 Pantisano et al. ..... 229/103
5,476,214 A * 12/1995 Fisk, Jr. ..... 229/103
D390,110 S * 2/1998 Mario ..... D9/433
6,299,918 B1 10/2001 Morgese
6,386,440 B1 * 5/2002 Tulkoff ..... 229/906
6,440,050 B1 8/2002 Capparelli et al.

* cited by examiner

*Primary Examiner*—Gary E. Elkins
(74) *Attorney, Agent, or Firm*—Miller Thomson LLP

(57) ABSTRACT

An ambidextrous sectional pizza box lid that can be divided into sections, which are shaped in such a way so that the sections can be easily grasped with either the left or right hand without the use of tools. The pizza box having a bottom portion and a top portion which comprises a top portion being removably attached to the bottom portion. The top portion may have plurality plate portions that are removably formed in the top portion and are shaped for ambidextrously grasping.

19 Claims, 2 Drawing Sheets

20
22
26
38
38

30
28
32
34

28
34
32

AMBIDEXTROUS SECTIONAL PIZZA BOX

This application claims benefit of 60/378,987 filed May 10, 2002.

FIELD OF INVENTION

This invention relates to pizza boxes and more particularly to an ambidextrous sectional pizza box lid that can be divided into sections that urges a user to easily grasp with either the left or right hand without the use of tools.

BACKGROUND OF INVENTION

A major part of the fast food and retail food markets is allocated to pizzas. On average over three billion pizzas are sold in the United States alone, of which 50% are take out. Millions of pizza boxes are therefore used to transport these take-out pizzas. Pizza boxes are well known and come in various shapes and sizes. While most boxes are square, it is known to have hexagonal, octagonal, circular and rectangular shaped boxes.

Pizza boxes are usually made out of corrugated cardboard or fiberboard and have a base and a lid. The base has a periphery with side walls extending vertically upward when the base is in an upright position. Similarly, the lid has a periphery with side walls extending vertically downward. Usually, the lid fits over the base and the base and the lid are hingedly connected to one another. In some pizza boxes, the base and lid are two separate pieces. The lid and base usually fit snugly relative to one another to keep the pizza as hot as possible. Due to the size of the traditional pizza box, pizza boxes are not easy to discard. As such, the user must some how break down or flatten the box to a size that allows the pizza box to be recycled.

In general, pizza is eaten in an informal manner. More specifically, pizza can be messy due to the ingredients and can be dangerous if still hot and not handled appropriately. To overcome the issues of temperature and neatness, the pizza can be distributed onto plates using utensils, which require cleaning after consumption of the pizza or one can use disposal plates, which add to the resulting garbage. Furthermore, some disposable plates are not rigid enough to support a piece of pizza. When plates are not readily available, the user is required to hold the pieces of pizza in their hands if the pizza is not too hot.

Prior art inventions have tried to address some of the aforenoted issues. U.S. Pat. No. 5,110,038 issued May 5, 1992 to Pantisano et al. discloses a plate forming and breakdown pizza box. The invention discloses a standard corrugated paper pizza box in a shape to form four circular serving plates with a beveled raised edge and cross slit cuts through the bottom panel of the pizza box separating the box into four essentially equal portion for easy disposal.

U.S. Pat. No. 5,476,214 issued Dec. 19, 1995 to Fisk Jr. for a pizza box with wedge-shaped break-down spatula plates. These plates can be separated from the box and more specifically the lid, and then used to lift out individual slices of pizza. The pizza slice resting on the plate can be picked up cleanly and safely ready to eat.

U.S. Pat. No. 5,014,853 issued May 14, 1991 to Crockett for a food delivery box. This invention relates to a pizza box that can be separated into sections that form plates on which the pizza can be eaten. Specifically, the top portion of the box is perforated from substantially central to the top portion through the flaps to define sections or plates.

Although the prior art addresses some of the issues surrounding breaking a pizza box into plates, the prior art does not specifically define a pizza box that allows the user to separate the pizza box lid into plates, that is configured for easy, flexible, gripping by a user to protect the user from the temperature of the pizza and is also configured specifically for urging users to grasp with either a right hand or left hand.

SUMMARY OF THE INVENTION

It is an object of the present invention to provide an ambidextrous sectional pizza box lid that can be divided into sections, and which are shaped in such a way so that the sections can be easily grasped with either the left or right hand without the use of tools.

In accordance with a preferred embodiment of the present invention there is provided a pizza box having a bottom portion and a top portion which comprises top portion being removably attached to the bottom portion. The top portion may have a plurality plate portions that are removably formed in the top portion and are shaped for ambidextrously grasping.

More specifically the bottom portion may be a base having a periphery with vertical sides extending upward therefrom when the base is in an upright position. The top portion may be further defined as a lid having vertical sides extending downward therefrom. The base and lid are sized and shaped to fit together. The lid may have a pattern of lines, which may divide the lid into several sections. The pattern may be such that the sections are configured so that they can be grasped either by a right hand or a left hand, for example a 90° triangle configuration. The lid is weakened along the lines of the pattern so that the sections can be easily separated from one another without the use of tools.

Preferably, the lines are formed by perforations, which extend along the lid and vertical sides. Conveniently, the ambidextrous sections include the lid and the vertical sides. The vertical sides may be flexible to allow them to bend and become a grasping portion for the user.

Advantages of the present invention include the ability for the user to easily break the top portion of the pizza box into a series of sections, some of which are configured to be naturally grasped by users who are right handed, and other sections which are configured to be grasped by left handed users. Flexible vertical sides allow the user to grasp the pizza and specifically the crust without touching the hot pizza.

BRIEF DESCRIPTION OF THE DRAWINGS

A detailed description of the preferred embodiments are provided herein below by way of example only and with reference to the following drawings, in which.

Figure 1:
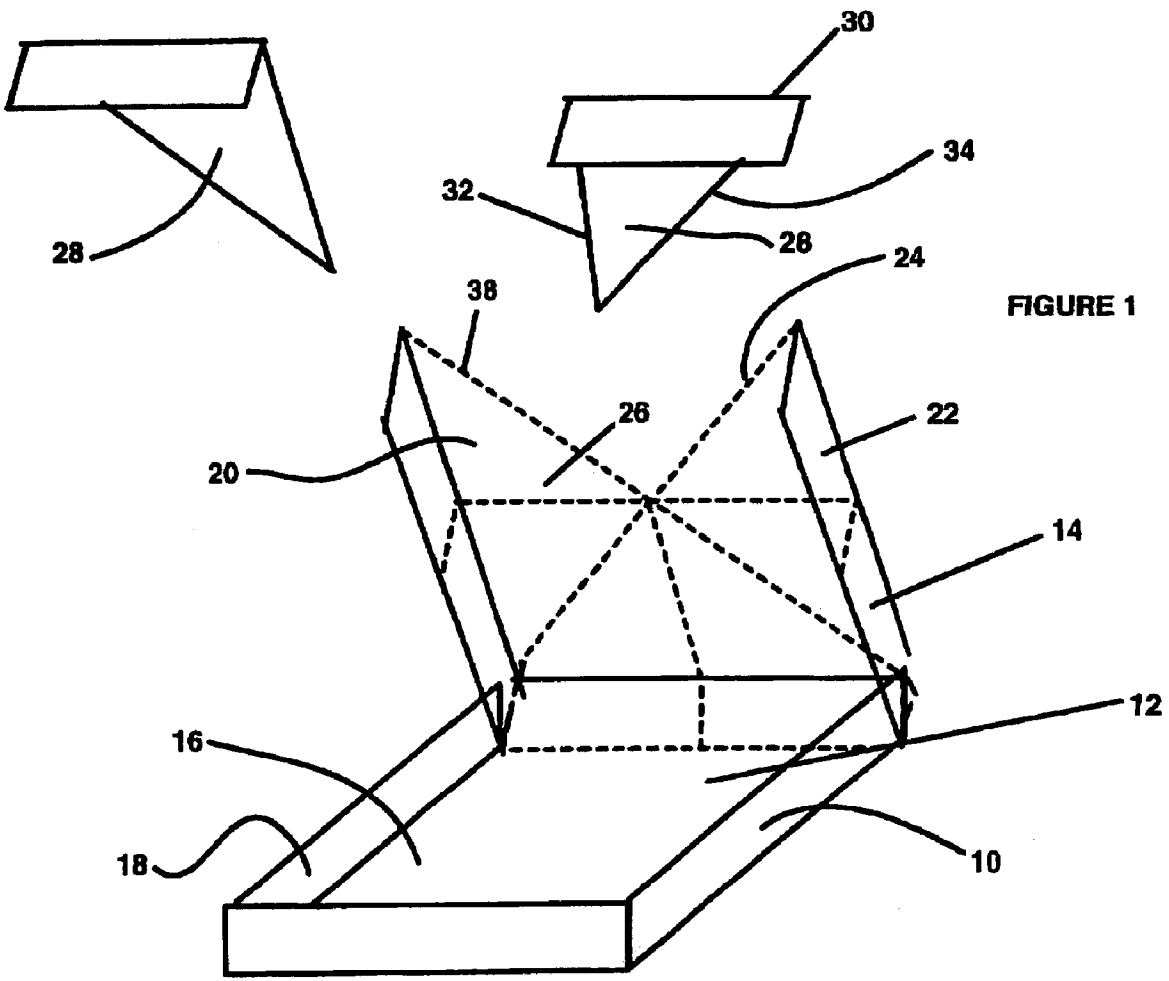
FIG. 1 is a perspective view of a pizza box lid with two sections of the lid removed.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION OF THE PREFERRED EMBODIMENT OF THE INVENTION

Figures 2, 3:
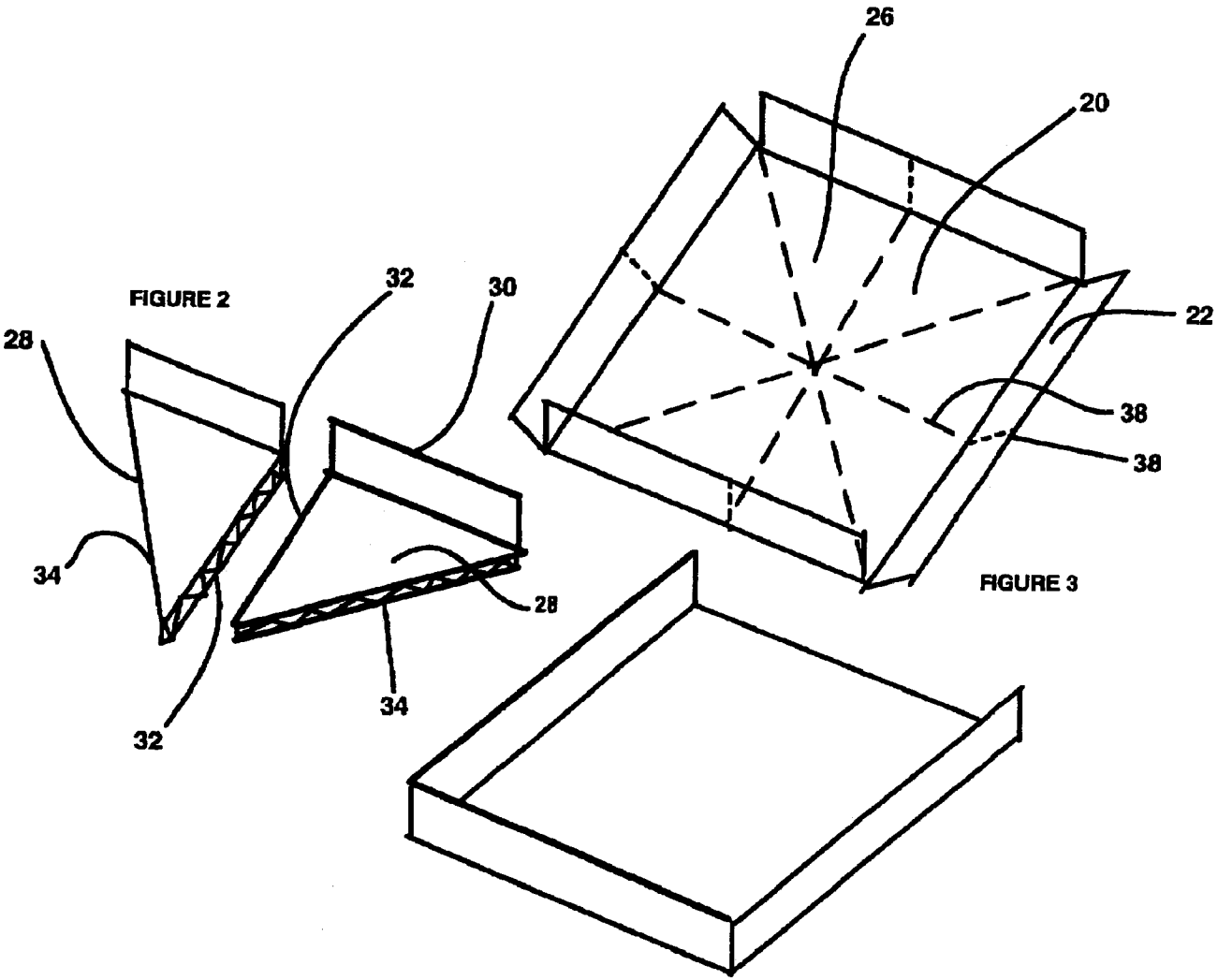
FIG. 2 is a perspective view of the ambidextrous sections of the preferred embodiment of the present invention.
FIG. 3 is a perspective view of the preferred embodiment of the invention with the lid separated from the bottom portion.

Referring to the Figures there is illustrated an ambidextrous sectional pizza box 10. Referring to FIGS. 1–3, there is provided a pizza box 10 having a bottom portion 12 removably connected to a top portion 14. The bottom portion 12 may be further defined as a base 16 having vertical sides 18 extending upward therefrom when the base 16 is in an upright position. The top portion 14 may be further defined as a lid 20 having vertical sides 22 extending downward therefrom. The base 16 and the lid 20 are configured so that they fit together.

The top portion 14 may have a pattern 24 defining a plurality of plate portions 26, which may be removably formed in the top portion 14. The plurality of plate portions 26 may be shaped or configured for grasping by the user's left hand or right hand and therefore are ambidextrous.

More specifically, the plate portions 26 may shaped like a 90° triangle 28. Triangle 28 may have a base side 30, a 90° straight side 32, and an angled side 34. The vertical sides 22 of top portion 14 generally form the base sides 30, which are flexible to allow the user to grasp the edge/crust of the pizza. The configuration of the triangle 28 and, more specifically, the positioning of the 90° straight side 32 indicates whether the plate portion 26 is for a right handed or left handed user. The user will naturally be urged to grasp that plate portion 26, from the 90° straight side 32, which will allow the user to eat from the angled side 34 while gripping the base side 30 thereby making the plate portions 26 ambidextrous. In other words, the positioning of the 90° straight side 32 on the left of base side 30 results in a plate position 26 that may be grasped by a left handed user. The positioning of the 90° straight side 32 on the right of the base side 30 results in a plate portion 26 that may be grasped by a right handed user.

The vertical sides 22 of the plate portion 26 can be part of the base sides 30 (depending on the configuration of the pizza box) and allows a user to comfortably hold the plate portion 26 with a crust (not shown) of a piece of pizza (not shown) abutting against the vertical sides 22.

Preferably, the pizza box 10 is made from corrugated cardboard. While the pizza box 10 is shown to have eight plate portions 26, depending on the size of the pizza box 10, the lid 20 can be divided into fewer or more than eight plate portions 26. Also, while each plate portion 26 preferably consists of the triangle 28 with the base side 30 or the vertical sides 22 hinged to the triangle 28, in some embodiments, the triangle 28 may not have the vertical side 22 hinged to the plate portion 26.

The lines creating the pattern 24 can be formed in various ways. Preferably, the lines are created by perforations 38 through the lid 20 and the vertical sides 22. In other words, individual perforations 25 combine to form a line. The perforations 38 can be any reasonable shape. The perforations 38 shown have an oblong shape. The perforations 38 can function as air vents to allow some of the steam from the pizza to escape and can replace some or all of the air vents found in conventional pizza boxes 10. Alternatively, the lines can be fold lines that are pressed into the lid 20 or the lid 20 can be scored along the lines creating the plate portions 26. The purpose of the lines is to weaken the lid 20 to such an extent that the plate portions 26 can be separated from one another along the lines without the use of tools.

While the invention has been described with square, rectangular and octagonally shaped pizza boxes 10, it can be used with pizza boxes 10 with virtually any shape including hexagonal and circular. The pizza box 10 of the present invention is more environmentally friendly than paper plates as the box must be disposed of in any event after it has been used to transport the pizza. The corrugated cardboard has an advantage in that it is stiff enough to support the pizza on a plate portion 26 and insulates the person holding the plate portion 26 from the heat of the piece of pizza. Also, the lid 20 is not substantially weakened before being separated into plate portions 26 and the pizza box 10 remains sufficiently strong to transport the pizza.

A further advantage of the plate portions 26 that are formed to extend from a periphery of the pizza box 10 to the centre is that the plate portions 26 will be slightly longer than a piece of pizza from the pizza box 10 that is cut from the edge of the pizza to the centre. The pattern of lines on the lid 20 can be formed in the same general pattern as the lines along which the pizza inside the box is cut.

Other variations and modifications of the invention are possible. All such modifications or variations are believed to be within the sphere and scope of the invention as defined by the claims appended hereto.

I claim:

1. A box for carrying pizza comprising:

(a) a bottom portion having a base with a periphery having vertical sides extending upward therefrom when said base is in an upright position;

(b) a top portion being removably connected to said bottom portion, and (c) a plurality of ambidextrous plate portions removably defined and formed within said top portion, wherein said ambidextrous plate portions are shaped as triangles so as to have a straight side positioned 90° either on the left of a base side or on the right of said base side thereby allowing for the ambidextrously grasping of said pizza with either a left hand or a right hand respectively.

2. A box for carrying pizza as claimed in claim 1 wherein said top portion is further defined as a lid having flexible vertical sides extending downwards therefrom, wherein said plurality of plate portions are defined and formed within said lid and said vertical sides.

3. A box for carrying pizza as claimed in claim 2 wherein said lid further comprises a pattern of lines defining said plurality of ambidextrous plate portions.

4. A box for carrying pizza as claimed in claim 3 wherein said plurality of plate portions are shaped as triangles having base sides, angled sides and straight sides.

5. A box for carrying pizza comprising:

a) a bottom portion having a base with a periphery having vertical sides extending upward therefrom when said base is in an upright position;

b) a lid having flexible vertical sides extending downwards therefrom and a pattern of lines defining a plurality of ambidextrous plate portions that are defined and formed within said lid and said vertical sides, said lid being removably connected to said bottom portions; and c) wherein said plurality of plate portions are shaped as triangles having base sides, angled sides and straight sides, said straight sides are positioned 90° on the left of said base sides allowing grasping of said plate portions from said 90° straight sides using a left hand.

6. A box for carrying pizza comprising:

(a) a bottom portion having a base with a periphery having vertical sides extending upward therefrom when said base is in an upright position;

(b) a lid having flexible vertical sides extending downwards therefrom and a pattern of lines defining a plurality of ambidextrous plate portions that are defined and formed within said lid and said vertical sides, said lid being removably connected to said bottom portions, and (c) wherein said plurality of plate portions are shaped as triangles having base sides, angled sides and straight sides, said straight sides are positioned 90° on the right of said base sides allowing grasping of said plate portions from said 90° straight sides using a right hand.

7. A box for carrying pizza as claimed in claim 5 or 6 wherein said angled sides of said triangle are oriented so that said pizza is consumed from said angled sides.

8. A box for carrying pizza as claimed in claim 5 or 6 wherein said flexible vertical sides of said lid are hingedly connected to said base sides of said triangles.

9. A box for carrying pizza as claimed in claim 5 or 6 wherein said vertical sides of said lid are removed from said base sides.

10. An ambidextrous sectional pizza box lid comprising:

(a) a top portion;

(b) flexible vertical sides extending downward from said top portion; and (c) a pattern defined on said top portion and said flexible vertical sides to form a plurality of removable ambidextrous plate portions shaped as triangles so as to have a straight side positioned 90° either on the left of a base side or on the right of said base side thereby allowing for the ambidextrously grasping of said plate portions with either a left hand or a right hand respectively.

11. An ambidextrous sectional pizza box lid as claimed in claim 10 wherein said plurality of plate portions are shaped as triangles having base sides, angled sides and straight sides.

12. An ambidextrous sectional pizza box lid comprising:

(a) a top portion;

(b) flexible vertical sides extending downward from said top portion; and (c) a pattern defined on said top portion and said flexible vertical sides to form a plurality of removable ambidextrous plate portions shaped as triangles having base sides, angled sides and straight sides, said straight sides are positioned 90° on the left of said base sides allowing grasping of said plate portions from said 90° straight sides using a left hand.

13. An ambidextrous sectional pizza box lid comprising:

(a) a top portion;

(b) flexible vertical sides extending downward from said top portion; and (c) a pattern defined on said top portion and said flexible vertical sides to form a plurality of removable ambidextrous plate portions shaped as triangles having base sides, angled sides and straight sides, said straight sides are positioned 90° on the right of said base sides allowing grasping of said plate portions from said 90° straight sides using a right hand.

14. An ambidextrous sectional pizza box lid as claimed in claim 12 or 13 wherein said angled sides of said triangle are oriented so that said pizza is consumed from said angled sides.

15. An ambidextrous sectional pizza box lid as claimed in claim 12 or 13 wherein said flexible vertical sides of said lid are hingedly connected to said base sides of said triangles.

16. An ambidextrous sectional pizza box lid as claimed in claim 12 or 13 wherein said vertical sides of said lid are removed from said base sides.

17. An ambidextrous sectional pizza box lid as claimed in claim 12 or 13 wherein said pattern on said pizza box lid are perforations allowing said plate portions to be removed and to allow the disassembling of said pizza box lid.

18. An ambidextrous sectional pizza box lid as claimed in claim 17 wherein said perforations are air vents.

19. An ambidextrous sectional pizza box lid as claimed in claim 17 wherein said sectional pizza box lid is manufactured from corrugated cardboard of sufficient strength to allow for the transportation of a pizza prior to being separated into said plate portions.

* * * * *